United States Patent [19]

Krohn et al.

[11] 4,109,446

[45] Aug. 29, 1978

[54] APPARATUS FOR FILLING AND CROWNING BOTTLES

[75] Inventors: Hans Güenther Krohn, Dortmund-Kirchorde; Friedrich Rademacher, Kamen, both of Fed. Rep. of Germany; Ulrich Petri; Hans D. Deubel, both of Elm Grove, Wis.

[73] Assignee: H & K, Inc., New Berlin, Wis.

[21] Appl. No.: 795,390

[22] Filed: May 10, 1977

[30] Foreign Application Priority Data

Feb. 19, 1977 [DE] Fed. Rep. of Germany ..... 2707307

[51] Int. Cl.[2] ..... B65B 3/00

[52] U.S. Cl. ..... 53/282; 198/482; 198/484

[58] Field of Search ..... 53/279, 282; 198/411, 198/412, 476, 480, 482–484, 729, 728, 734

[56] References Cited

U.S. PATENT DOCUMENTS

| | | | |
|---|---|---|---|
| 2,029,823 | 2/1936 | Huntley et al. | 53/279 |
| 2,484,101 | 10/1949 | Krueger | 198/482 X |
| 2,500,465 | 3/1950 | Meyer | 198/482 |
| 2,621,841 | 12/1952 | Simpson | 53/279 |
| 3,378,129 | 4/1968 | Mencacci | 53/282 X |
| 3,572,490 | 3/1971 | Babunovic | 198/476 |
| 3,599,776 | 8/1971 | Babunovic | 198/480 |

*Primary Examiner*—Robert Louis Spruill
*Attorney, Agent, or Firm*—Andrus, Sceales, Starke & Sawall

[57] ABSTRACT

An apparatus for filling and closing containers, such as bottles. The apparatus includes a rotary filling machine for moving each bottle in a circular path of travel and filling the bottle with liquid. The bottles are crowned by a rotating crowner which is located adjacent the filling machine and the crowner which is located adjacent the filling machine and the crowner moves each bottle in a circular path of travel and applies the crown to the filled bottle to close the bottle. An endless chain transfer conveyor having a plurality of pockets to receive the bottle serves to transfer the bottles from the filling machine to the crowner and from the crowner to a discharge conveyor. The chain is driven by a sprocket mounted on the crowner and the chain moves tangentially to the circular path of travel of the filling machine, so that the bottles are transferred from the filling machine to the pockets on the chain conveyor. After crowning, the bottles are transferred from the pockets in the chain to the discharge conveyor by a stripper member. As the filled, uncrowned bottles moving from the filling machine to the crowner move in a straight path of travel they are not subjected to centrifugal force and thereby liquid loss and air entrapment are minimized.

12 Claims, 3 Drawing Figures

1
2
5
8
9
10
11
12
13
17
18
19
20
21
22
23
24
25
26
27
28
29
30
31
32
33

APPARATUS FOR FILLING AND CROWNING BOTTLES

BACKGROUND OF THE INVENTION

Rotary filling machines are commonly used to fill bottles, such as beer bottles, with liquids. In the conventional filling machine, empty bottles are delivered on a linear conveyor and are then fed by an in-feed star-wheel conveyor to the rotary table or turret of the filling machine. The turret is equipped with bottle supports or platforms which individually lift the bottles against filling valves mounted on the upper portion of the machine. Depending on the capacity of the filling machine the diameter may vary from 2 to 6 meters.

After filling, the bottles are transferred by a star-wheel conveyor to a crowner which applies the cap or crown to the filled bottle. In the crowner the bottles are supported on a rotating table and as the crowner rotates the crown is applied and crimped to the bottle.

In the conventional arrangement, the filled bottles are transferred to the crowner by a star-wheel conveyor operating at high speed, thereby subjecting the bottles to considerable centrifugal force. The centrifugal force causes the beverage level in the neck of the bottle to incline, and depending on the angle of inclination, the beverage can spill from the neck. This problem is particularly evident in the case of short-necked bottles in which the filling point is close to the bottle rim, resulting in an unexpectedly high spillage rate. Because of this problem, the speed of operation of the filler and crowner is limited.

As a further problem, the filled, uncrowned bottle changes direction during its high speed travel on the star-wheel conveyor, and the inclined beer level moves rapidly from one side of the bottle neck to the other, thereby tending to entrap air within the beer. Inclusion of air within the beer can cause decomposition of the beer during storage.

In the conventional filling and crowning arrangement it is customary to mechanically agitate the beer after it is in the bottle to cause the beer to foam into the neck of the bottle to thereby displace the air from the bottle neck prior to capping. The amount of agitation is controlled so that the foam will slightly spill over the top of the bottle. If the beer level is inclined, as occurs when the bottle is subjected to considerable centrifugal force, the mechanical agitation must be regulated so that the low end of the liquid level is foamed to the top of the neck and this results in a substantial over-foaming of the high end of the liquid level. This spillage due to foaming in the conventional arrangement can amount to approximately five barrels per hour for a conventional machine operating at a speed of 1200 bottles per minute.

SUMMARY OF THE INVENTION

The invention relates to an apparatus for filling and closing containers, such as bottles, and particularly to a transfer mechanism for transferring the bottles from the filling machine to a crowner and for transferring the crowned bottles to a discharge conveyor.

The filling machine moves each bottle in a circular path of travel while filling the bottle with liquid. After filling, the bottle is transferred to the crowner where the bottles are again moved in a circular path of travel, while the crowns are applied to the bottles.

In accordance with the invention, an endless chain transfer mechanism is utilized to transfer the filled bottles from the filling machine to the crowner and to transfer crowned bottles to a discharge conveyor. The chain is trained over a drive sprocket, which is connected to and synchronized with the crowner, and an idler sprocket. The chain moves from the idler sprocket tangentially to the circular path of travel of the bottles on the filling machine, and the bottles are transferred from the filling machine to pockets on the transfer chain. The bottles are maintained in the pockets as the bottles move around the crowner, and after crowning the bottles are transferred from the pockets in the chain to the discharge conveyor by a stripper member which is disposed at an angle to the direction of movement of the chain conveyor.

With the structure of the invention, the bottles are transferred from the filling machine to the crowner and subsequently transferred from the crowner to the discharge conveyor by the endless transfer chain. The filled bottles, prior to crowning, travel in a straight line path to the crowner so they are not subjected to centrifugal force. As the filled uncrowned bottles are not subjected to centrifugal force, spillage and air entrapment are eliminated.

As the liquid level in the neck of the filled bottle remains substantially horizontal as the bottle is transferred from the filling machine to the crowner, a more accurately controlled mechanical agitation of the beer can be employed to thereby minimize overfoaming and spillage.

The apparatus of the invention is capable of being utilized with either new or existing equipment and can be installed with existing equipment with minimum alteration or modification.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
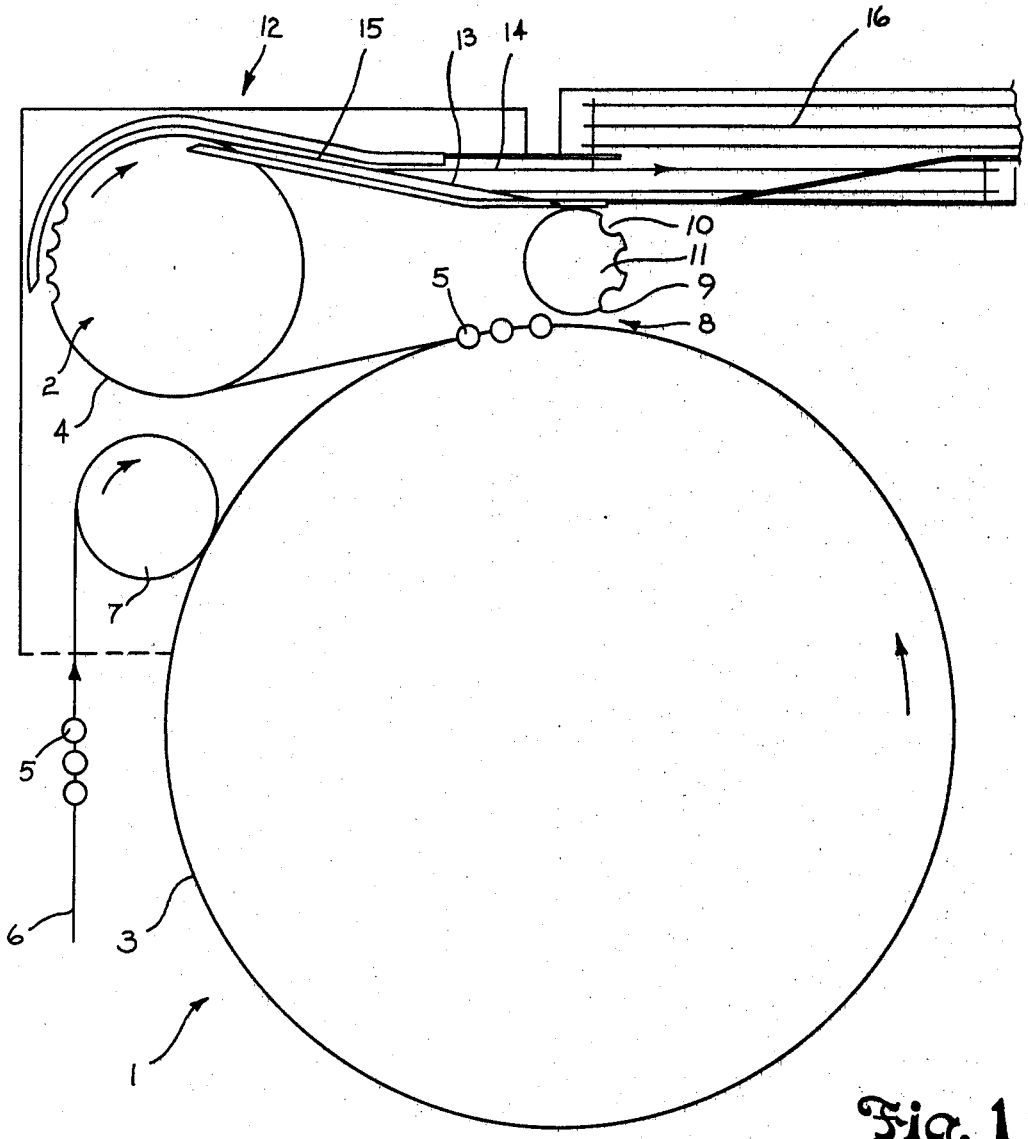
FIG. 1 is a schematic representation showing the invention.
Figure 3:
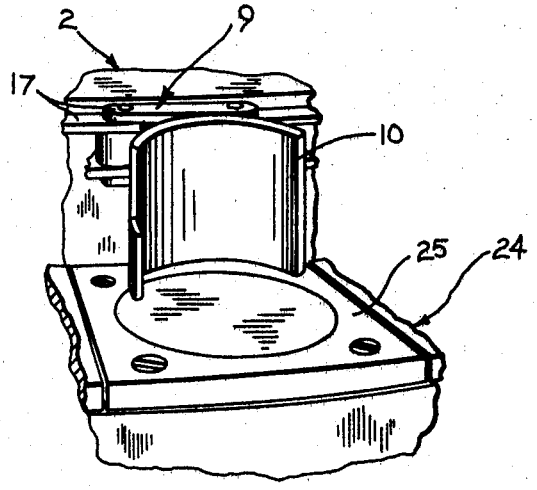
FIG. 3 is a perspective view showing the transfer chain and pockets.

FIG. 1 is a schematic representation of the invention and illustrates a filling machine 1 and a synchronized crowner 2. The filling machine 1 and crowner 2 are of conventional construction and in themselves form no part of the present invention.

The filling machine 1 has an effective pitch circle indicated by 3, while the crowner 2 has a pitch circle indicated by 4. The bottles 5 move through the pitch circles 3 and 4 during the filling and crowning operations.

The empty bottles 5 are delivered to the system by conveyor 6 and are transferred to the circle 3 of the filling machine by an in-feed star-wheel conveyor 7 of conventional construction. As the bottles move on the pitch circle 3, they are filled with the beverage, after air evacuation and carbon dioxide counter-pressure. At the discharge end 8 of the filling machine 1, bottles are transferred to a transfer conveyor 9 which consists of an endless roller chain equipped with links of uniform pitch and carrying a series of bottle pockets 10 which conform generally to the contour and diameter of the bottles 5.

The transfer conveyor 9 moves tangentially to the pitch circle 3 and is driven by the crowner 2. The transfer conveyor 9 is also carried by a smaller diameter sprocket 11.

After crowning, the bottles are transferred at the discharge area 12 of the crowner 2 to a table top chain conveyor 13. As shown in FIG. 1, the conveyor 13 runs at a slight angle, indicated by 14, to the angle of travel, indicated by 15, of the transfer conveyor 9. This insures a smooth and gentle transfer of the bottles between the transfer chain 9 and the discharge conveyor 13. Downstream the bottles moves from the discharge conveyor 13 to a multiple conveying system indicated by 16.

Figure 2:
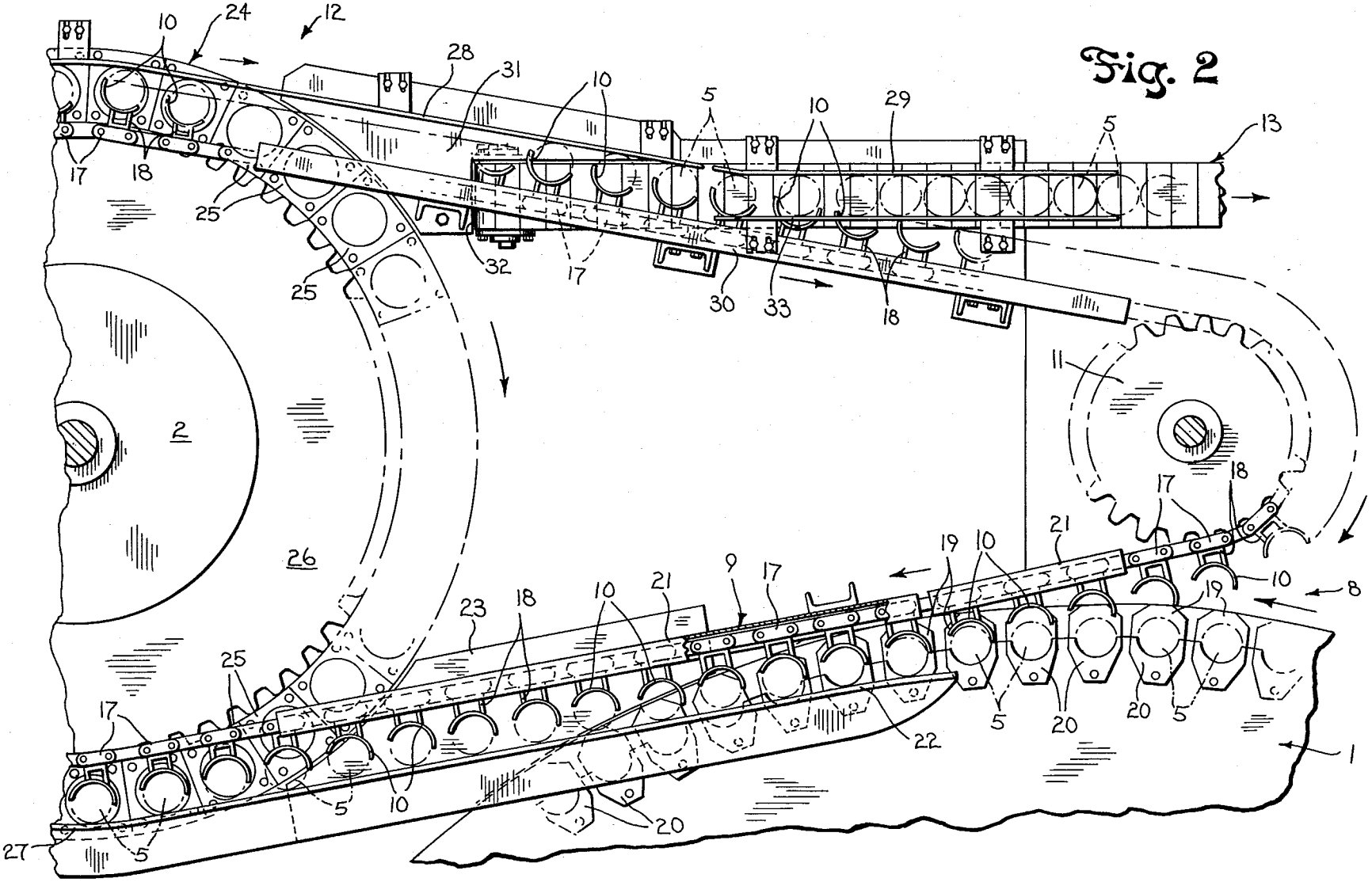
FIG. 2 is a fragmentary plan view of the invention.

As shown in FIG. 2, the chain 9 is a conventional type composed of a series of pivotally connected links 17, and channel brackets 18 are connected to the links 17 and carry the generally curved pockets 10. The pockets are preferably formed of a metal, such as stainless steel, covered with a plastic coating to prevent abrasion or damage to the bottles. As shown in FIG. 2, the open side of each pocket faces slightly forward in the direction of travel of the chain to thereby facilitate transfer of the bottles from the filler to the pockets and to subsequently facilitate transfer of the bottles from the pockets 10 to the discharge conveyor 13.

The filling machine 1, as previously mentioned, is a standard type including a plurality of circumferentially spaced platforms 19, each of which has a curved pocket 20 which supports an individual bottle. The platforms 19 move the bottles upwardly to the filling elements, as the filler is rotated.

Chain guides 21 are located at the discharge side of the idler sprocket 11 and the chain guides have a generally U-shaped cross section so that the channel brackets 18 of chain 9 project outwardly of the open side of the chain guides.

The bottles 5 are transferred or stripped from the pockets 20 on platforms 19 and into the pockets 10 by a stripper bar 22 which extends at a slight angle to the periphery of the filler 1, as illustrated in FIG. 2.

A fixed slide plate 23 is mounted between the peripheral edge of the filling machine 1 and the peripheral edge of the table 24 of the crowner 2, and the bottles 5 located within the pockets 10 of the chain 9 are moved across the slide plate 23 to the crowner.

As best illustrated in FIG. 2, the table or turret 24 of the crowner is formed of a plurality of segments 25, each of which is adapted to support a bottle.

The chain 9 is engaged with a drive sprocket 26 which is mounted concentrically of the crowner and is driven in synchronization with the turret or table 24. A guide bar 27, which is an extension to the stripper bar 22, extends around the crowners to retain the bottles in position on the table 24 as the crowner rotates. As shown in FIG. 2, a guide bar 28 extends outwardly from the guide bar 27 and terminates in a section 29 which is generally parallel to the side edge of discharge conveyor 13.

Located parallel to the guide bar 28 is a chain guide 30 which is similar in construction to chain guide 21. Located between the crowner 2 and the discharge conveyor 13 is a stationary slide plate 31. As shown in FIG. 2, one edge of the slide plate 31 is located in proximate relation to the peripheral edge of the table 24, while the opposite edge of the slide plate is provided with a notch 32 which receives the end of conveyor 13.

After the bottles 5 are crowned, they travel in a straight path of travel on slide plate 31 in a direction toward the idler sprocket 11 and this path of travel is at an acute angle with respect to the direction of movement of the discharge conveyor 13. The bottles 5 are transferred from the pockets 10 of the transder conveyor 9 to the conveyor 13 by a stripper bar 33 which is mounted along the side edge of conveyor 13. The moving bottles engage the stripper bar 33 and are guided onto the discharge conveyor 13. The stripper bar 33 is at a level such that the pockets 10 will pass beneath the stripper bar, while the bar will engage the portion of the bottle located above the pocket.

With the construction of the invention, the filled, but uncrowned bottles, moving from the filler to the crowner travel in a straight line path so that the liquid within the bottle is not subjected to centrifugal force. Thus, the liquid level in the neck of the bottle will remain substantially horizontal to eliminate spilling and air entrapment, as can occur when using a conventional transfer mechanism. As the liquid level is not subjected to centrifugal force, the filler and crowner can operate at substantially higher speeds.

As the liquid level in the uncrowned bottle remains horizontal during transfer from the filler to the crowner, a more controlled mechanical agitation system can be utilized to foam the beverage and produce a minimum amount of spillage. This produces a substantial reduction in loss of beverage over conventional systems.

The apparatus of the invention can be utilized with new equipment, as well as existing equipment. Minimum modification or alteration of existing equipment is required in order to install the transfer mechanism of the invention.

Various modes of carrying out the invention are contemplated as being within the scope of the following claims particularly pointing out and distinctly claiming the subject matter which is regarded as the invention.

We claim:

1. An apparatus for filling and closing containers, comprising a rotary filling means for moving each container in a first generally circular path and filling the container with liquid; rotary crowning means synchronized with the filling means for moving each container in a second generally circular path and applying a crown to each filled container; a discharge conveyor located adjacent the crowning means for discharging crowned containers; and conveying means for conveying the containers from the filling means to the crowning means and for conveying the crowned containers from the crowning means to the discharge conveyor, said conveying means comprising an endless member, a plurality of generally curved pockets carried by the endless member and disposed to receive and hold individual containers, a drive member operably connected to the endless member and mounted on the crowning means and disposed to rotate in synchronization therewith to thereby drive the endless member, an idler member connected to the endless member, said endless member disposed to move in a first generally linear path of travel from the idler member to the drive member with said path of travel being generally tangential to the circular path of travel of the containers on the filling means, whereby the containers are transferred from the filling means to said pockets, said endless member being disposed to move in a second generally linear path of travel from the drive member toward the idler member, said second path of travel being disposed at an angle to the direction of movement of the discharge conveyor, and transfer means for transferring the containers from the pockets to the discharge conveyor as said endless member moves along said second path of travel.

2. The apparatus of claim 1, wherein said endless member is a chain, said containers are bottles and said pockets have a generally curved contour to complement said bottles.

3. The apparatus of claim 1, wherein transfer means comprises a stationary stripper bar disposed at an acute angle to said second linear path, said bottles moving along said second linear path engaging said stripper bar and being guided onto said discharge conveyor.

4. The apparatus of claim 1, wherein said first circular path of travel has a greater diameter than the second circular path of travel.

5. The apparatus of claim 3, wherein said discharge conveyor is disposed to travel in a linear path generally parallel to said stripper bar.

6. The apparatus of claim 2, wherein each pocket has an open side facing outwardly of said chain.

7. The apparatus of claim 1, wherein said endless member is a chain and said crowning means includes a rotatable table to support the containers, said drive member being a sprocket mounted concentrically with said table and located at a higher elevation than said table.

8. An apparatus for filling and crowning bottles, comprising a rotary filling machine for moving each bottle in a first circular path of travel and filling the bottle with liquid; a rotary crowner disposed adjacent the filling machine for moving each filled bottle in a second circular path of travel and applying a crown to each bottle; a discharge conveyor disposed to travel in a linear path and located adjacent said crowner; and conveying means for conveying the bottles from the filling machine to the crowner and for conveying crowned bottles from the crowner to the discharge conveyor, said conveying means comprising an endless chain, a plurality of generally curved pockets carried by the chain and having a contour to receive and complement the bottles, a drive sprocket mounted concentrically of said crowner and disposed to rotate in synchronization therewith, an idler sprocket disposed in spaced relation to said drive sprocket, said chain being trained over said drive sprocket and said idler sprocket, said chain disposed to move in an endless path of travel, said path of travel including a first generally linear section disposed tangentially to said first circular path of travel whereby bottles are transferred from the filling machine to said pockets as the chain moves along said first linear section of said path of travel, said path of travel also including a second generally linear section extending generally tangentially to said second circular path of travel, and transfer means located between the crowner and the idler sprocket for transferring said bottles traveling along said second linear section from the pockets to the discharge conveyor.

9. The apparatus of claim 8, and including second transfer means for transferring said bottles from said first circular path of travel on said filling machine to said pockets on the portion of the chain travelling along said first linear section.

10. The apparatus of claim 8, wherein said drive sprocket has a greater diameter than said idler sprocket.

11. The apparatuus of claim 8, wherein said crowner includes a rotatable table to support the bottles and said drive sprocket is mounted concentrically of said table and is disposed at a level above the table.

12. The apparatus of claim 8, wherein said transfer means comprises an elongated stripper member disposed at an acute angle to said second linear section, said bottles moving along said second linear section engaging said stripper member and being guided onto said discharge conveyor.

* * * * *